United States Patent [19]

Kikuchi et al.

[11] 4,293,024

[45] Oct. 6, 1981

[54] SPRAY DEVICE FOR A DIE CASTING MACHINE

[75] Inventors: Tsuyoshi Kikuchi, Atsugi; Kiyoshi Takusagawa, Zama, both of Japan

[73] Assignee: Toshiba Kikai Kabushiki Kaisha, Tokyo, Japan

[21] Appl. No.: 102,126

[22] Filed: Dec. 10, 1979

[51] Int. Cl.[3] ..... B22D 17/20

[52] U.S. Cl. ..... 164/303; 425/90

[58] Field of Search ..... 164/303, 149, 404; 425/107, 90, DIG. 116

[56] References Cited

U.S. PATENT DOCUMENTS

| | | | |
|---|---|---|---|
| 3,270,379 | 9/1966 | Sehn et al. | 164/404 X |
| 3,544,355 | 12/1970 | Ott | 164/149 X |
| 3,765,474 | 10/1973 | Burton | 164/404 X |

*Primary Examiner*—Robert D. Baldwin
*Assistant Examiner*—J. Reed Batten, Jr.
*Attorney, Agent, or Firm*—Koda and Androlia

[57] ABSTRACT

A die casting machine comprises a pair of relating movable die plates, a pair of mold halves attached to the opposing surfaces of the die plates, and a spray device for spraying mold releasing agent to inner surfaces of the mold halves. The spray device comprises a cylinder-piston assembly secured to a support member mounted on one of the die plates, a link mechanism being operated by the movement of the cylinder-piston assembly, and a spray head supported at the front end of the link mechanism and provided with a plurality of spray guns. The spray guns are positioned in a space between the mold halves when the link mechanism is moved to a predetermined inclined position by the operation of the cylinder-piston assembly.

3 Claims, 4 Drawing Figures

10
12
13
14
15
15a
16
16a
17
17a
18
19
20
20a
21
21a
22
23
24
25
26
27
28
30
3
7
8
9

SPRAY DEVICE FOR A DIE CASTING MACHINE

BACKGROUND OF THE INVENTION

This invention relates to an improvement of a spray device for spraying a mold releasing agent onto inner surfaces of mold halves of a die casting machine after taking out a molded product from the mold halves and blowing off chips remaining in the mold halves to clean the inner surfaces thereof.

A prior art die casting machine including a spray device is schematically shown in FIG. 1, in which a hydraulic or pneumatic cylinder-piston assembly 1 is secured to a stationary die plate 3 through a bracket 2 attached thereto. A spray head 4 provided with a plurality of spray guns 6 each having a cock is supported by the lower end of a piston rod 5 of the cylinder-piston assembly 1 so as to be vertically movable in accordance with the operation of the assembly 1. Movable and stationary mold halves 7 and 8 are supported by movable and stationary die plates 9 and 3, respectively.

In FIG. 1, the spray guns 6 eject a mold releasing agent such as Chem-Trend (Trade Mark, Chem-Trend Corp., U.S.A.) for preventing seizure of molten metal injected into the die mold halves. After the mold releasing agent has been sprayed, the spray head 4 is raised by the operation of the cylinder-piston assembly 1 and the movable die plate 9 is then slidably moved so as to engage the movable mold half 7 with the stationary mold half 8.

With the arrangement of the die casting machine of the type described above, the spray device of the die casting machine has to be moved to a position where the spray head 4 does not hinder the operation for exchanging the molds every time when the movable and stationary molds are exchanged with other ones. Although it is possible to change areas of the inner surfaces of the molds to be sprayed with the mold releasing agent by properly opening or closing respective cocks of the spray guns 6 in accordance with the dimensions of the molds exchanged, it is required to increase the stroke of the piston rod 5 in conformity with the dimensions of the molds. It is important to spray the mold releasing agent in a quantity which is sufficient, but, not excessive, over the entire surfaces of the molds. However, in an actual injection molding work, since various molds having different dimensions are used, a spray head with a number of spray guns must be used in order to satisfactorily spray the mold releasing agent onto the inner surfaces of the molds. This fact increases the number of spray guns 6, and elongates the piston stroke of the cylinder-piston assembly 1. Moreover, mist of the sprayed mold releasing agent is often generated when the mold releasing agent is sprayed from a large number of spray guns, and the spray guns 6 are choked by adhesion of splashed mold releasing agent. For the reason described above, troublesome maintenance of the spray guns should be made periodically, which results in additional work for an operator. Furthermore, after one spraying process, the spray head 4 is raised directly upwardly and the movable mold half 7 is moved to engage the stationary mold half 8. At this time, die molds or a molded product are often spoiled by "after-dribble" of the mold releasing agent from the spray guns 6 positioned directly above the molds. The drops or after-dribble of the mold releasing agent damage the appearance and quality of the molded product.

SUMMARY OF THE INVENTION

Accordingly, an object of this invention is to obviate the defects described above and to provide an improved spray device of a die casting machine capable of being easily operated and obtaining a molded product having fine appearance and good quality.

Another object of this invention is to provide a spray device having a link mechanism which acts so that the spray guns are always moved to a desired position between movable and stationary mold halves while the gun holder is maintained in the vertical position and removed from the operating position to a position not directly above the molds.

According to this invention there is provided a die casting machine of the type comprising a pair of relatively movable die plates, a pair of mold halves attached to the opposing surfaces of the die plates, respectively, and means for spraying mold releasing agent to inner surfaces of the mold halves, characterized in that the spray means comprises a support movably mounted on one of said die plates, a cylinder-piston assembly secured to the support, a link mechanism connected to a piston rod of the cylinder-piston assembly and pivotably attached to the support, and a spray head supported by one end of the link mechanism and provided with a plurality of spray guns, the spray guns being positioned in a space between said mold halves when said link mechanism is moved to a predetermined inclined position by the operation of the cylinder-piston assembly.

DESCRIPTION OF THE PREFERRED EMBODIMENT

Figure 1:
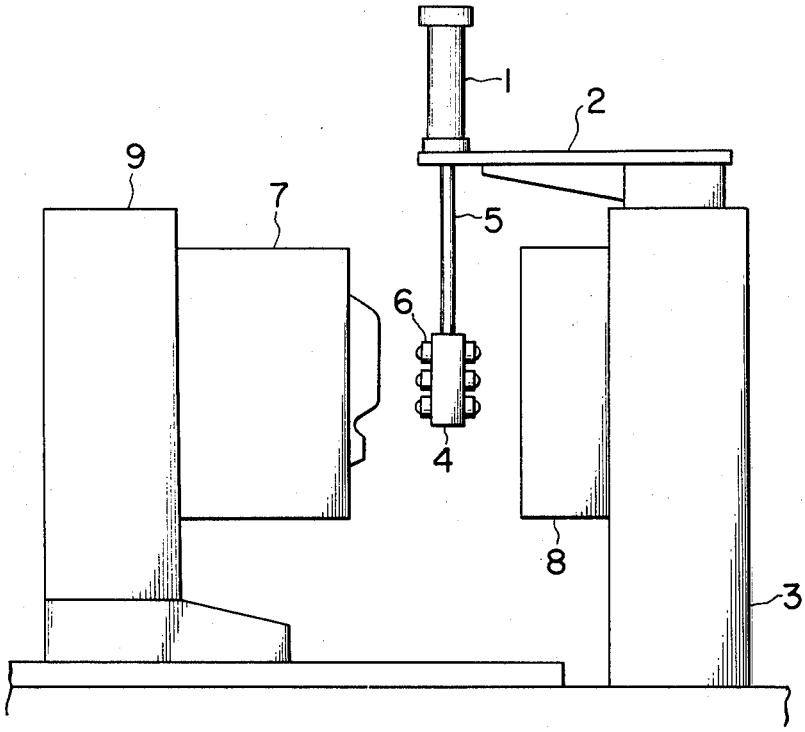
FIG. 1 PRIOR ART
FIG. 1 is a schematic side view of a die casting machine including a spray device of a prior art.
Figure 4:
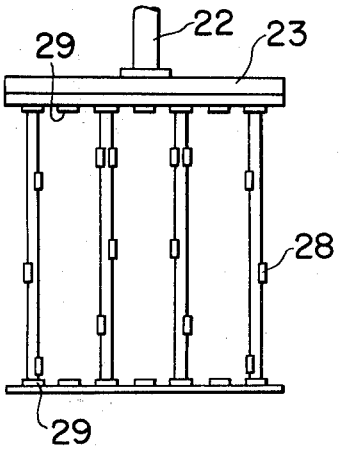
FIG. 4 is a schematic view of spray guns supported by a spray head of the spray device shown in FIG. 2.
Figures 2, 3:
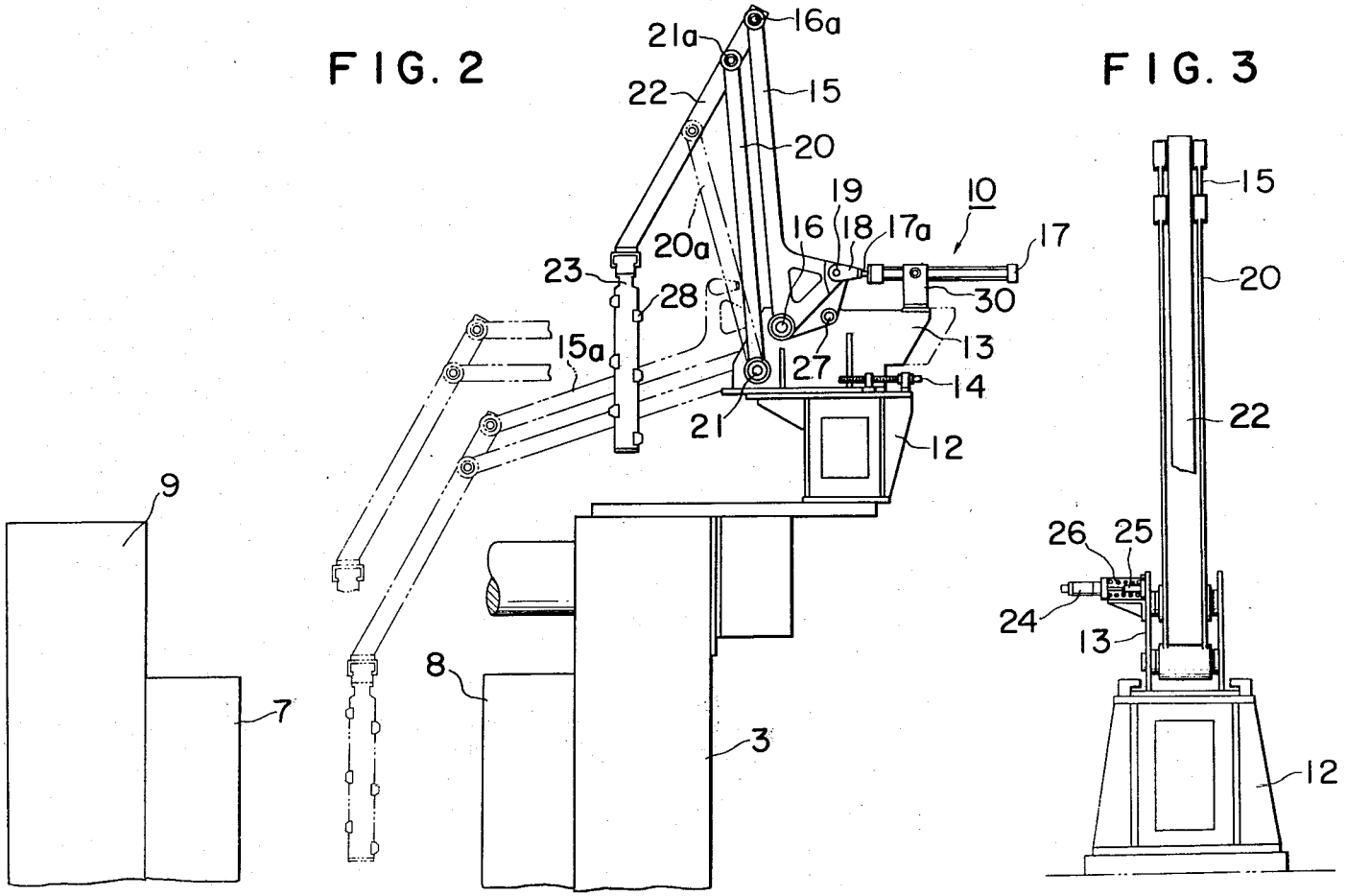
FIG. 2 is a schematic view of a spray device of a die casting machine according to this invention.
FIG. 3 shows a side view of the die casting machine shown in FIG. 2.

In FIGS. 2 and 3, a support table 12 for supporting a spray device 10 is secured to a stationary die plate 3 of a die casting machine by bolts, not shown. The spray device 10 includes a support 13 mounted on the support table 12 and attached thereto by means of adjustable screws 14 to be movable horizontally in FIG. 2.

A link 15 is pivotably attached at one end to the support 13 by a pin 16 and the link 15 is driven by a hydraulic cylinder-piston assembly 17 which is mounted on the support 13 through a member 30. A piston rod **17*a* of the cylinder-piston assembly 17 is connected at its front end to a joint member 18 which is attached to a protruded portion formed on one side of the link 15 by a pin 19 so that the link 15 is rotatable about the joint member 18. A link 20 parallel to the link 15 is positioned on the other side thereof and has substantially the same length as that of the link 15. The link 20 is pivotably attached at one end to the support 13 by a pin 21. The other ends of the links 15 and 20 are rotatably connected to a link 22 by pins 16*a* and 21*a*, and the distance between these pins 16*a* and 21*a* is determined to be substantially equal to that between the pins 16 and 21. Thus, a parallelogram link mechanism is formed by members connecting the pins 16, 16*a*, 21*a*, and 21**.

The links 15, 20 and 22 of this link mechanism are rotatably connected by means of the pins 16, 16*a*, 21 and 21*a*. As shown in FIG. 3, the links 15 and 20 are provided on both sides of the support 13 so as to hold the link 22 between the links 15 and the links 20.

A spray head 23 provided with a plurality of spray guns 28 is detachably supported by the front or lower end of the link 22. Cylinder means 24, FIG. 3, is attached to the support 13 and a pin 25 is secured to the cylinder means 24. A coil spring 26 is disposed between the support 13 and the cylinder means 24 so that the spring 26 urges the pin 25 to insert it into a hole 27 formed on the support 13 for stopping the link 15 at a predetermined position and preventing the spray device 10 from falling down when the spray device takes a spray stand-by position on the stationary plate 3.

According to the arrangement of the spray device of the type described hereinabove, when the hydraulic cylinder-piston assembly 17 is driven, the piston rod 17*a* advances leftwardly in FIG. 2, so that the links 15 and 20 will rotate about pins 16 and 21, and when the piston rod 17*a* reaches a limit of its forward stroke and the links 15 and 20 take most inclined positions shown by phantom lines 15*a* in FIG. 2, the spray guns 28 are brought into the space between the movable and stationary mold halves 7 and 8. The mold releasing agent is then sprayed over the entire inner surfaces of the mold halves 7 and 8. The spray guns 28 are respectively detachably supported by supporting members 29 of the spray head 23 so that the number of the spray guns can be varied in accordance with the dimensions of the molds to be used.

In the foregoings, there is described one specific embodiment of the spray device of this invention which includes a parallelogram link mechanism comprising links 15, 20, and 22 and pins 16, 16*a*, 21 and 21*a* connecting the links as shown in FIG. 2. However, it is of course possible to modify the link mechanism to any quadrilateral link mechanism as long as the spray guns supported by the front end of the link 22 are positioned between the molds 7 and 8 while maintaining them in vertical position when the piston rod 17*a* of the hydraulic cylinder-piston assembly 17 advances and reaches its limit position. For example, it is possible to attach one end of the link 20 to the link 22 as shown by phantom line 20*a* in FIG. 2.

According to this invention, since a spray head provided with a plurality of spray guns is raised and moved to a position not above the mold or space therebetween after a mold releasing agent has been sprayed, the spray head does not hinder the movement of the mold when it is exchanged with another one, and the spray head is not positioned directly above the molds, so that the mold or molded products are not soiled with "after-dribble" of the mold releasing agent from the spray guns. Thus, there is obtained a molded product having fine appearance and good quality.

We claim:

1. In a die casting machine of the type comprising a pair of relatively movable die plates, a pair of mold halves attached to the opposing surfaces of said die plates, respectively, and means for spraying mold releasing agent to inner surfaces of said mold halves, the improvement in which said spray means comprises a support movably mounted on one of said die plates, a cylinder-piston assembly secured to said support, a link mechanism consisting of a quadrilateral linkage connected to a piston rod of said cylinder-piston assembly and pivotably attached to said support, and a spray head supported by and fixed relative to one end of said link mechanism and provided with a plurality of spray guns, said spray guns being positioned in a space between said mold halves when said link mechanism is moved to a predetermined inclined position by the operation of said cylinder-piston assembly.

2. The die casting machine according to claim 1 wherein said quadrilateral linkage comprises a first link having one end pivotably attached to said support and a projection which is connected to said piston rod of said cylinder-piston assembly, a second link with one end pivotably attached to said support, and a third link to which the other ends of said first and second links are pivotably connected, said spray head being vertically supported by a free end of said third link.

3. The die casting machine according to claim 2 wherein said first and second links are parallel with each other and have substantially the same length thereby to form a parallelogram link mechanism.

* * * * *